US011056817B2

(12) United States Patent
Liang et al.

(10) Patent No.: US 11,056,817 B2
(45) Date of Patent: Jul. 6, 2021

(54) ELECTRICAL CONNECTOR HAVING POSITIVE AND NEGATIVE CONTACTS WITH STRUCTURES OFFSET FROM EACH OTHER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yun-Kui Liang, Kunshan (CN); Fang-Hua Shu, Kunshan (CN); Yun Qi, Kunshan (CN); Jian Shao, Kunshan (CN); Zhi-Jian Chen, Kunshan (CN); Xue-Wu Bu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/827,600

(22) Filed: Mar. 23, 2020

(65) Prior Publication Data

US 2020/0303859 A1 Sep. 24, 2020

(30) Foreign Application Priority Data

Mar. 22, 2019 (CN) ..... 201910222310.0

(51) Int. Cl.
*H01R 13/428* (2006.01)
*H01R 13/436* (2006.01)

(52) U.S. Cl.
CPC ..... *H01R 13/428* (2013.01); *H01R 13/4361* (2013.01)

(58) Field of Classification Search
CPC ..... H05K 7/20436; H05K 7/20127; H05K 7/20145; H01R 12/7088; H01R 12/716;
(Continued)

(56) References Cited

U.S. PATENT DOCUMENTS 2,755,453 A * 7/1956 Cloutier ..... H01R 9/16 439/741
5,007,858 A * 4/1991 Daly ..... H01R 23/661 439/498

(Continued)

FOREIGN PATENT DOCUMENTS

CN 101567500 10/2009
CN 101587995 11/2009

(Continued)

*Primary Examiner* — Abdullah A Riyami
*Assistant Examiner* — Marcus E Harcum
(74) *Attorney, Agent, or Firm* — Ming Chieh Chang; Wei Te Chung

(57) ABSTRACT

An electrical connector includes an insulative housing having opposite mating port and mounting port. Plural pairs of contacts are retained in the housing. Each pair of contacts has a first contact blade and a second contact blade. Each of the first contact blade and the second contact blade includes a main body, a contacting section extending into the mating port, and a mounting leg of the main body disposed in the mounting port. Each of the main body of the first contact blade and the main body of the second contact blade forms an embossment abutting against each other so as to electrically unify both the first contact blade and the second contact blade without blocking the space therebetween for enhancing heat dissipation thereof.

14 Claims, 7 Drawing Sheets

(58) Field of Classification Search
CPC .. H01R 12/722; H01R 12/712; H01R 12/724; H01R 13/42; H01R 13/428; H01R 13/4361
USPC ..... 439/741, 485, 206
See application file for complete search history.

(56) References Cited

U.S. PATENT DOCUMENTS

| | | | | | |
|---|---|---|---|---|---|
| 5,085,601 | A * | 2/1992 | Buchter | H01R 12/82 | 439/660 |
| 5,711,067 | A * | 1/1998 | Jenner | H01R 4/2429 | 29/874 |
| 5,980,325 | A * | 11/1999 | Horchler | H01R 43/20 | 439/660 |
| 6,733,302 | B1 * | 5/2004 | Smalley, Jr. | H01R 12/7088 | 439/65 |
| 6,972,968 | B2 * | 12/2005 | Hwang | G02B 6/4277 | 174/383 |
| 7,578,696 | B2 * | 8/2009 | Yuan | H01R 13/447 | 439/485 |
| 7,726,982 | B2 * | 6/2010 | Ngo | H01R 13/42 | 439/79 |
| 8,043,097 | B2 * | 10/2011 | Ngo | H01R 12/7088 | 439/79 |
| 8,419,482 | B1 | 4/2013 | Alltop | | |
| 8,968,009 | B2 * | 3/2015 | Chen | H01R 12/7088 | 439/79 |
| 9,136,645 | B1 * | 9/2015 | Yu | H01R 13/4223 | |
| 9,960,514 | B1 * | 5/2018 | Chen | H01R 12/724 | |
| 10,069,262 | B2 * | 9/2018 | Little | H01R 12/724 | |
| 10,181,674 | B1 * | 1/2019 | Sykes | H01R 12/7088 | |
| 2009/0149060 | A1 * | 6/2009 | Zhu | H01R 12/716 | 439/485 |
| 2010/0184339 | A1 * | 7/2010 | Ngo | H01R 12/7088 | 439/682 |
| 2011/0076871 | A1 * | 3/2011 | Yu | H01R 12/7088 | 439/345 |
| 2011/0287658 | A1 * | 11/2011 | Yu | H01R 12/7088 | 439/485 |
| 2013/0065414 | A1 * | 3/2013 | Yu | H01R 12/716 | 439/206 |
| 2013/0109224 | A1 * | 5/2013 | Chin | H01R 12/7088 | 439/485 |
| 2014/0349529 | A1 * | 11/2014 | Flickinger | H01R 4/10 | 439/834 |
| 2015/0162683 | A1 * | 6/2015 | Hung | H01R 12/724 | 439/485 |
| 2015/0180176 | A1 * | 6/2015 | Yu | H01R 13/64 | 439/135 |
| 2016/0156138 | A1 * | 6/2016 | Yuba | H01R 13/53 | 439/682 |
| 2017/0373419 | A1 * | 12/2017 | Lee | H01R 13/4226 | |
| 2018/0366843 | A1 * | 12/2018 | Maki | H01R 13/6315 | |
| 2020/0169029 | A1 * | 5/2020 | Sun | H01R 12/727 | |

FOREIGN PATENT DOCUMENTS

| | | |
|---|---|---|
| CN | 201774046 | 3/2011 |
| CN | 102157824 | 8/2011 |
| CN | 201956471 | 8/2011 |
| CN | 102185198 B | 3/2013 |
| CN | 203119143 | 8/2013 |
| CN | 107887754 | 4/2018 |
| CN | 207781944 U | 8/2018 |

* cited by examiner

ELECTRICAL CONNECTOR HAVING POSITIVE AND NEGATIVE CONTACTS WITH STRUCTURES OFFSET FROM EACH OTHER

BACKGROUND OF THE INVENTION

1. Field of the Invention

The invention relates to the electrical connector, and particularly to an electrical connector with good heat dissipation.

2. Description of Related Arts

China Patent No. CN203911048U discloses an electrical connector including an insulative housing with at least one set of power contacts and at least one set of signal contacts. Anyhow, because the power contact has a U-shaped structure for linking the opposite spring fingers, the heat dissipation is inferior.

Hence, an electrical connector with the good heat dissipation effect, is desired.

SUMMARY OF THE INVENTION

To achieve the above object, an electrical connector includes an insulative housing having opposite mating port and mounting port. Plural pairs of contacts are retained in the housing. Each pair of contacts has a first contact blade and a second contact blade. Each of the first contact blade and the second contact blade includes a main body, a contacting section extending into the mating port, and a mounting leg of the main body disposed in the mounting port. Each of the main body of the first contact blade and the main body of the second contact blade forms an embossment abutting against each other so as to electrically unify both the first contact blade and the second contact blade without blocking the space therebetween for enhancing heat dissipation thereof.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
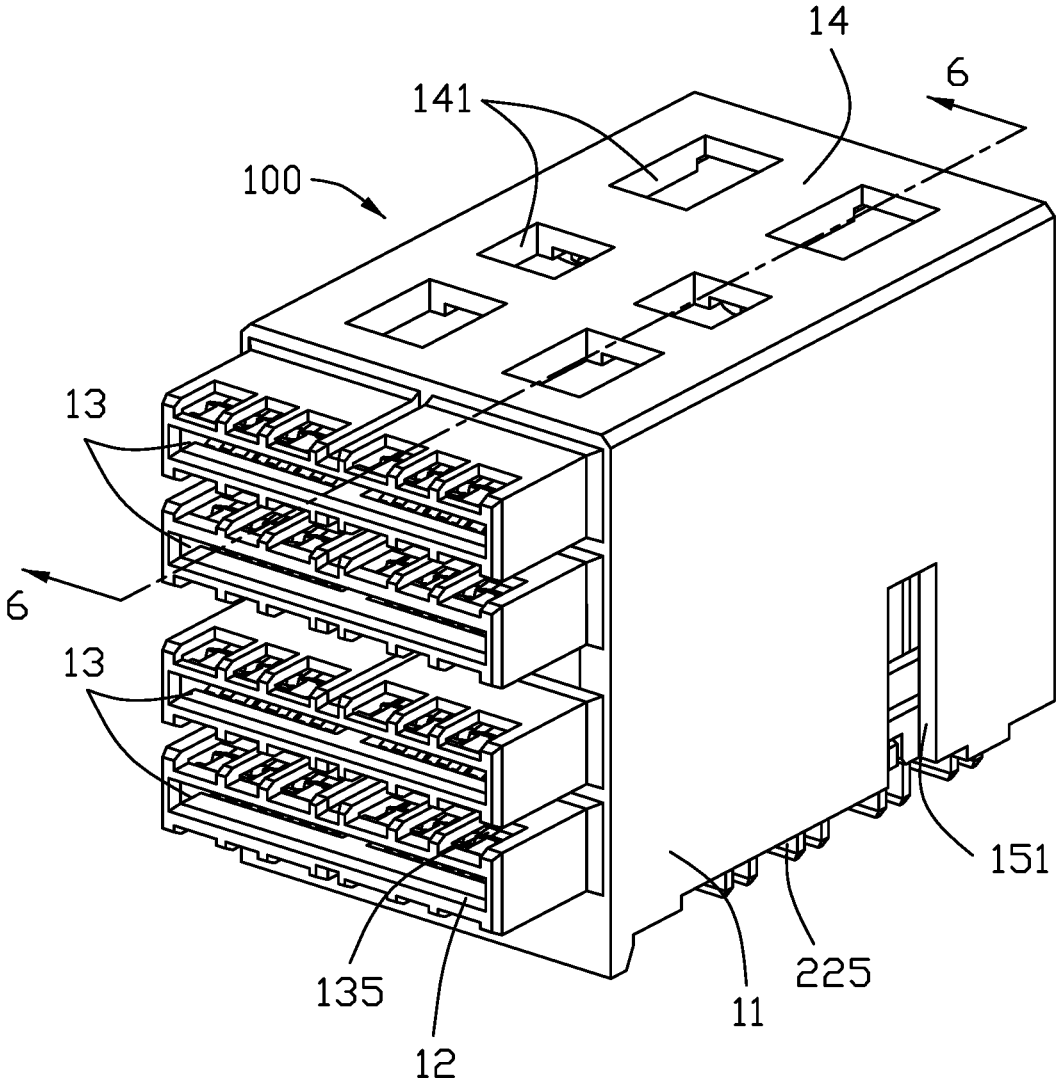
FIG. 1 is a perspective view of the electrical connector according to the present invention.
Figure 2:
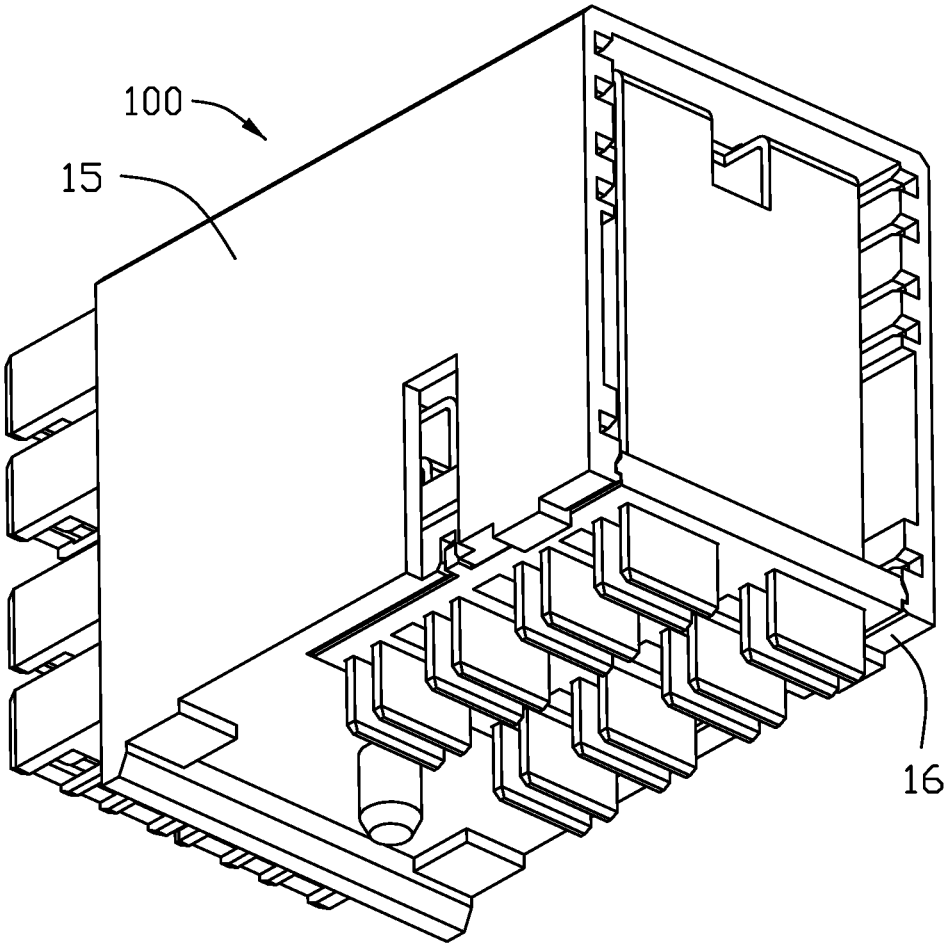
FIG. 2 is another perspective view of the electrical connector of FIG. 1.

Referring to FIGS. 1-7, an electrical connector 100 includes an insulative housing 10, plural pairs of contacts 20 retained in the housing 10, and a spacer 30 retaining the mounting legs of the contacts 20. The housing 10 includes a main portion 11, a mating port 12 forwardly extending from the main portion 11, and a mounting port 16 below the main portion 11. The mating port 12 forms four mating cavities 13 including a first mating cavity 131, a second mating cavity 132, a third mating cavity 133 and a fourth mating cavity 134. A distance between the first mating cavity 131 and the second mating cavity 132 is same with that between the third mating cavity 133 and the fourth mating cavity 134. The first mating cavity 131 and the second mating cavity 132 commonly form a first mating part wherein the first mating cavity 131 is for negative connection while the second mating cavity 132 is for positive connection. Similarly, the third mating cavity 133 and the fourth mating cavity 134 commonly form a second mating part wherein the third mating cavity 133 is for negative connection while the fourth mating cavity 134 is for positive connection. Notably, the distance between the first mating part and the second mating part, i.e., the distance between the second mating cavity 132 and the third mating cavity 133 is larger than that between the first mating cavity 131 and the second mating cavity 132 or that between the third mating cavity 133 and the fourth mating cavity 134. The housing 10 forms a plurality of holes 135 and a groove 136 in both sides of each mating cavity 13.

The contacts 20 include four pairs of contacts 20 corresponding to the four mating cavities 131, 132, 133, 134. Each pair of contacts 20 includes a first contact blade 201 and a second contact blade 202 facing toward each other. Each of the first contact blade 201 and the second contact blade 202 includes a main body 22, a contacting section 21 extending forwardly from the main body 22 into the same corresponding mating cavity 13. The main body 22 of each of the first contact blade 201 and the second contact blade 202 forms a pair of embossments 221. The embossments 221 of the first contact blade 201 and those of the second contact blade 202 abut against each other in the vertical direction for electrical connection therebetween. The contacting section 21 includes a plurality of spring fingers 211. A retaining slot 222 is formed in the main body 22 for engagement with the housing 10. The main body 22 includes a horizontal part 223 and a vertical part 224. The horizontal parts 223 of the four pairs of contacts 20 decrease gradually in the front-to-back direction from the uppermost one to the lowest one. The vertical section 224 of the four pair of contacts 20 decrease gradually in the vertical direction from the rearmost one to the frontmost one. The spring finger 211 extends from the front end region of the horizontal part 223, and the embossment 223 is located upon the horizontal part 223. The vertical section 224 forms a pair of mounting legs 225.

Figure 7:
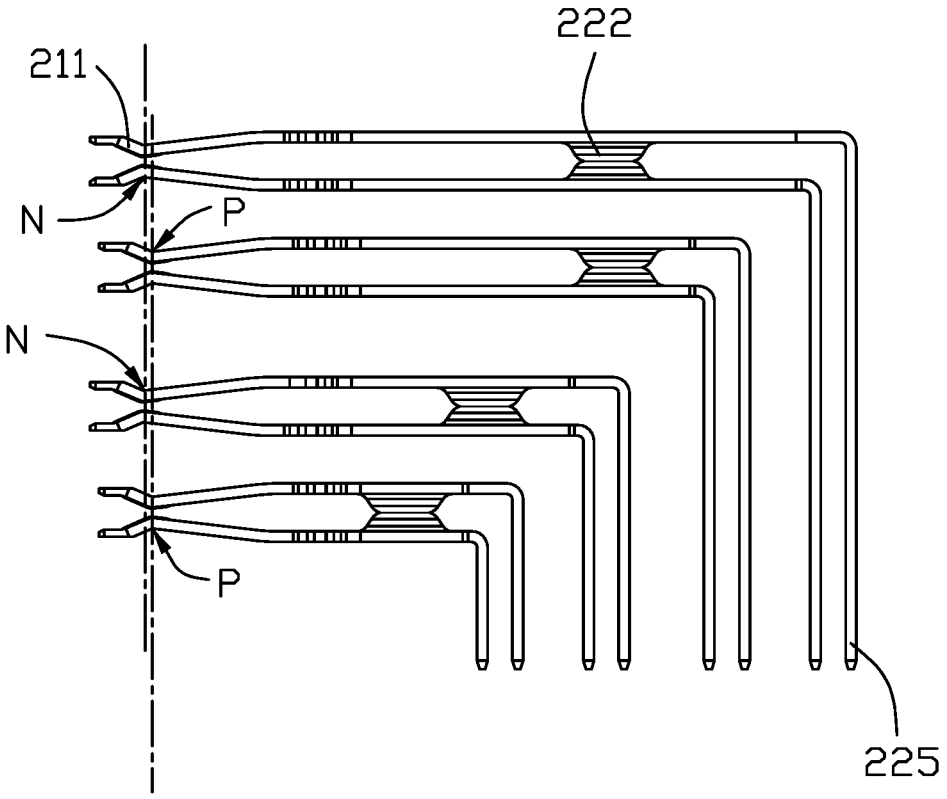
FIG. 7 is a side view of the electrical contact of the electrical connector of FIG. 6.

The contacting section 21 is located beside the corresponding mating cavity 13 in the vertical direction. The spring finger 211 is expose in the corresponding hole 135. Understandably, the contacting sections 21 in the first mating cavity 131 and the third mating cavity 133 are for negative connection while those in the second mating cavity 132 and the further mating cavity 134 are for positive connection. As shown in FIG. 7, because the contact point N of the connecting sections 21 performing negative connection is located in front of the contact point P performing positive connection, the grounding effect occurs before power connection for arc prevention during mating with the complementary connector.

The mounting port 16 is located around a bottom of the housing 10. A receiving space is formed in the housing to receive the corresponding contacts 20. The receiving space forms four receiving cavities 101 to receive the horizontal parts 223 of the four pairs of contacts 20. A plurality of partitions 17 are formed in the housing 10 to separate the receiving cavities 101. Notably, the length of the partition 17 complies with the length of the horizontal part 223 of the corresponding contact 20. A plurality of guiding blocks 18 are formed around the partitions 17 so as to receive the corresponding retaining slots 222 for securing the contacts 20 in the housing 10. The mounting legs 25 extend downwardly beyond the bottom face of the housing 10. The housing 10 includes a bottom wall 19 with the corresponding mounting posts 191, and the mounting legs 25 are located behind the bottom wall 19.

The main portion 11 of the housing 10 includes a top wall 14 and two side walls 15. A plurality of heat dissipation holes 141 are formed in the top wall 14, a plurality of holes 151 are formed in the side wall 15. The holes 151 extend through the bottom face of the housing 10. A spacer 30 is attached to the bottom side of the housing 10, and includes a plurality of positioning holes 31 to retain the corresponding mounting legs 225, and a plurality of heat dissipation holes 32 cooperating with the heat dissipation holes 141 to enhance airflow moving in the vertical direction. Notably, the embossments 221 formed on the main body 22 to form airpath by two sides for allowing the airflow to pass in the front-to-back direction so as to enhance the airflow moving along the front-to-back direction.

Figure 3:
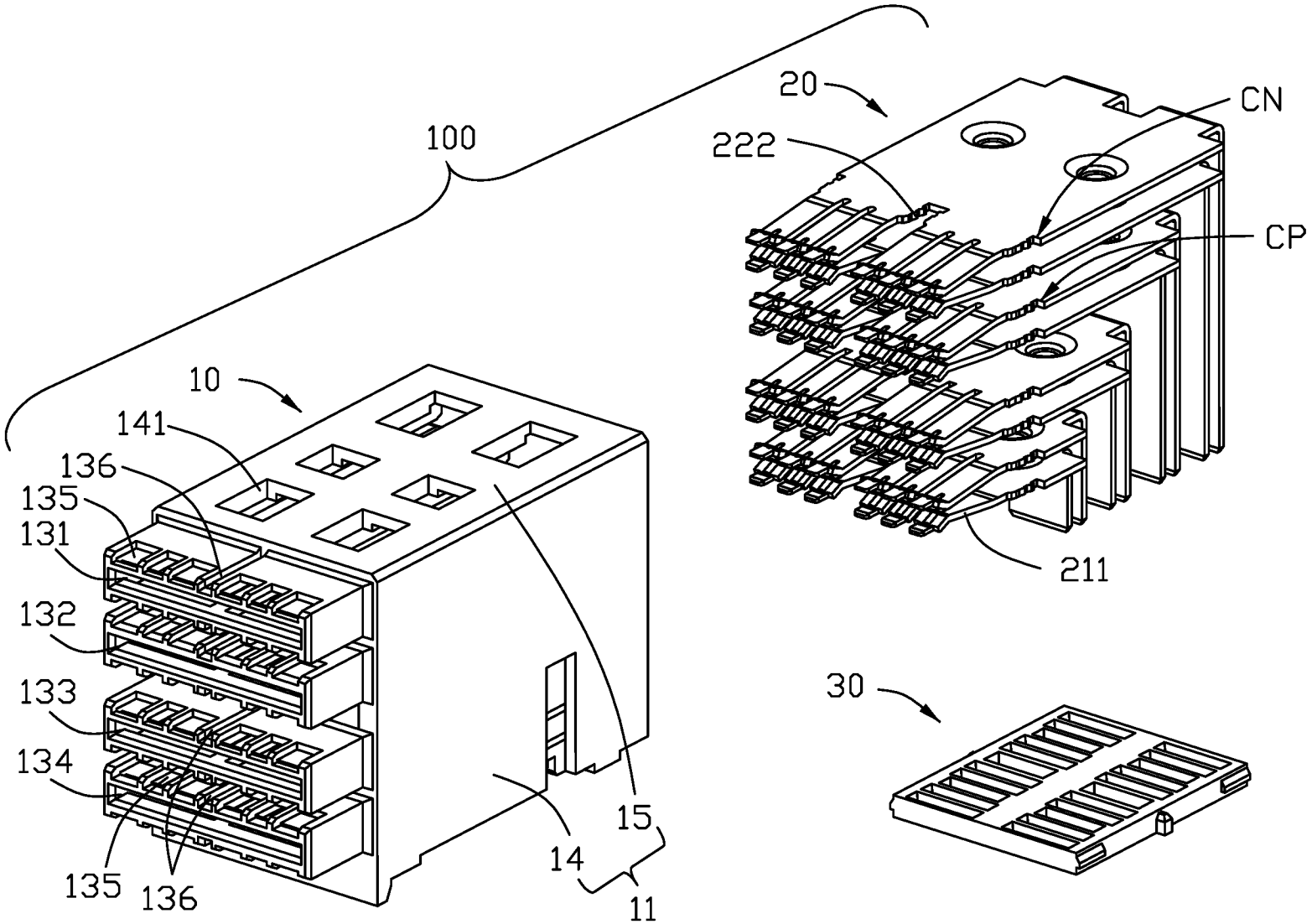
FIG. 3 is an exploded perspective view of the electrical connector of FIG. 1.
Figure 4:
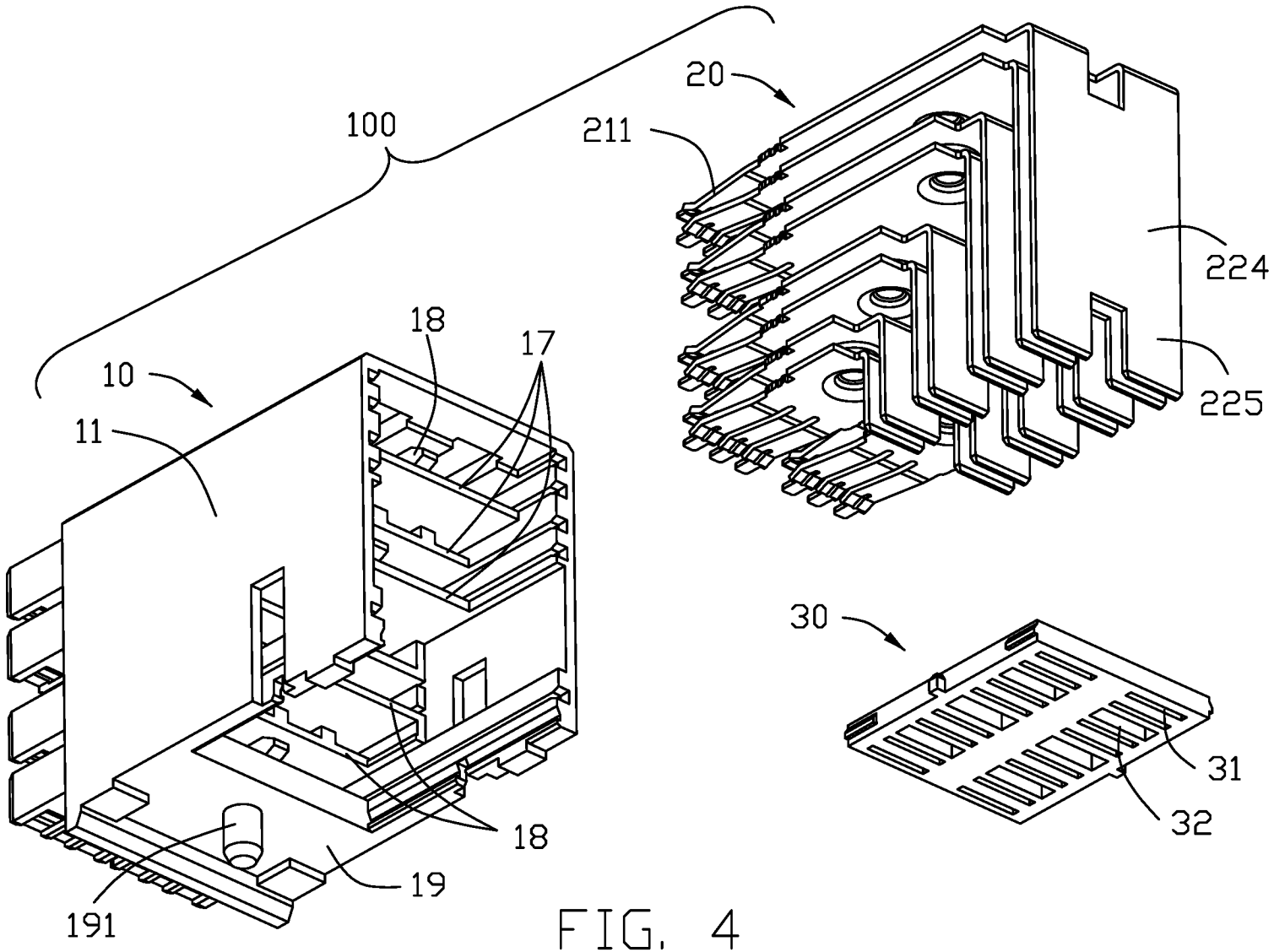
FIG. 4 is another exploded perspective view of the electrical connector of FIG. 3.
Figure 5:
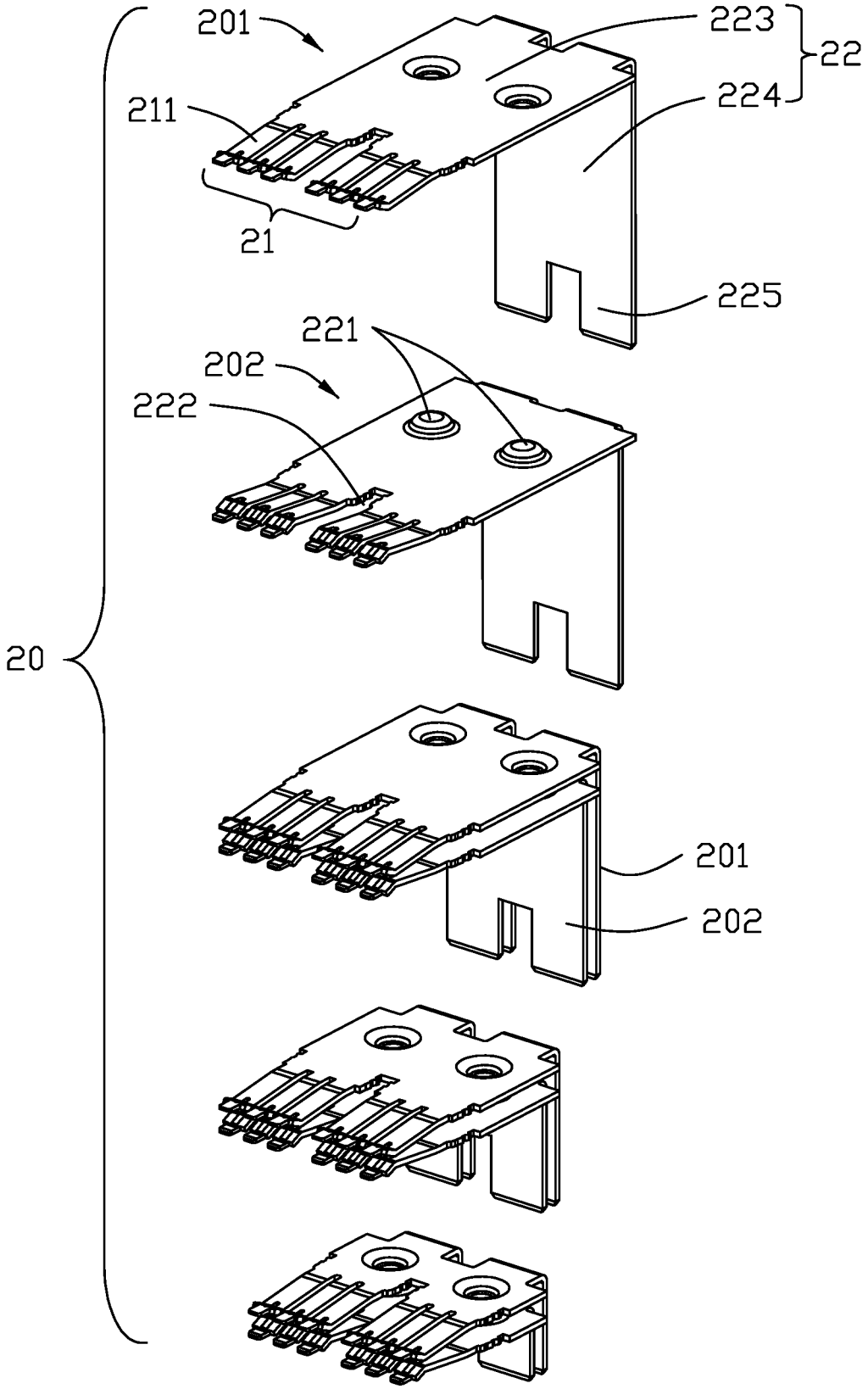
FIG. 5 is an exploded perspective view of the electrical contact of the electrical connector FIG. 3.
Figure 6:
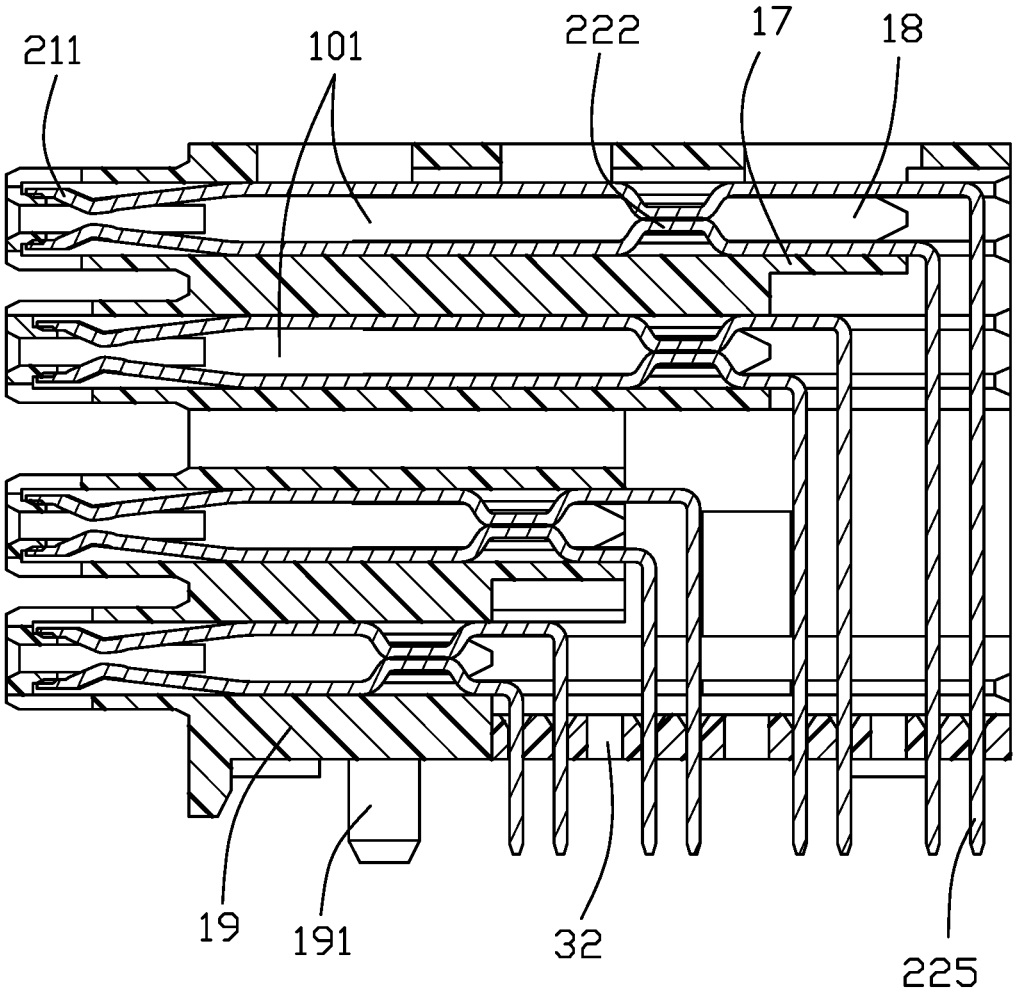
FIG. 6 is a cross-sectional view of the electrical connector of FIG. 1.

In this embodiment, as shown in FIG. 3 each main body 22 forms a shoulder behind the barbed structure wherein the shoulder CN of the main body 22 of the contact 20 performing negative connection is located in front of that of the contact 20 performing positive connection so as to have the contact point N of the contacting section 21 performing negative connection located in front of the contact point P of the contacting section 21 performing positive connector mentioned before.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing including a main portion with a mating port extending forwardly from the main portion, a mounting port below the main portion;

plural pairs of contacts retained in the housing, each pair of contacts having a first contact blade and a second contact blade spaced from each other, each of the first contact blade and the second contact blade including a main body, a contacting section forwardly extending from the main body into a corresponding mating cavity; wherein in each pair of contacts, the contacting section of the first contact blade and that of the second contact blade extend into the same mating cavity, and each of said first contact blade and the second contact blade includes at least one embossment, and the embossment of the first contact blade abuts against that of the second contact blade in said vertical direction for electrical connection therebetween;

wherein some pairs of contacts performing negative connection while others thereof performing positive connection, wherein the main body of each of first contact blade and the second contact blade forms a shoulder behind corresponding barbed structures, and the shoulder of the main body of the contact performing the negative connection is located in front of that of the contact performing the positive connection.

2. The electrical connector as claimed in claim 1, wherein an airpath is formed by two sides of the embossment to allow airflow moving along a front-to-back direction perpendicular to the vertical direction.

3. The electrical connector as claimed in claim 1, wherein the main body includes a horizontal part from which the contacting section forwardly extends, and a vertical part from which at least one mount leg extends downwardly into the mounting port.

4. The electrical connector as claimed in claim 3, further including a spacer attached to the mounting port, wherein said spacer including a plurality of positioning holes to retain the corresponding mounting legs, and a plurality of heat dissipation holes.

5. The electrical connector as claimed in claim 4, wherein the main portion of the housing includes a top wall with a plurality of heat dissipation holes to cooperate with the heat dissipation holes in the spacer to enhance airflow moving in the vertical direction.

6. The electrical connector as claimed in claim 5, wherein the main portion further includes a pair of side walls each forming a heat dissipation hole extending through a bottom face of the housing.

7. The electrical connector as claimed in claim 4, wherein the mating port forms a plurality of holes extending therethrough in the vertical direction, and the contacting sections are exposed in the corresponding holes for heat dissipation.

8. The electrical connector as claimed in claim 3, wherein the embossment is formed on the horizontal part of the main body.

9. The electrical connector as claimed in claim 1, wherein a contact point of the contacting section of the contact performing negative connection is located in front of the contact point of the connecting section performing positive connection.

10. The electrical connector as claimed in claim 1, wherein the main body of each of the first contact blade and the second contact blade forms a retaining slot in a front end region to engage a corresponding guiding block of the housing.

11. An electrical connector comprising:

an insulative housing including a main portion with a mating port extending forwardly from the main portion, a mounting port below the main portion; the mating port including a plurality of mating cavities spaced from one another in a vertical direction;

plural pairs of contacts retained in the housing, each pair of contacts having a first contact blade and a second contact blade spaced from each other, each of the first contact blade and the second contact blade including a main body, a contacting section forwardly extending from the main body into the corresponding mating cavity; wherein in each pair of contacts, the contacting section of the first contact blade and that of the second contact blade extend into the same mating cavity, and at least one of said first contact blade and the second contact blade includes at least one embossment extending toward to abut against the second contact blade in said vertical direction for electrical connection therebetween; wherein some pairs of contacts performing negative connection while others thereof performing positive connection, and a contact point of the contacting section performing negative connection is located in front of the contact point of the connecting section performing positive connection;

wherein the main body of each of first contact blade and the second contact blade forms a shoulder behind corresponding barbed structures, and the shoulder of the main body of the contact performing the negative connection is located in front of that of the contact performing the positive connection.

12. An electrical connector comprising:

an insulative housing including a main portion with a mating port extending forwardly from the main portion, a mounting port below the main portion;

the mating port including a plurality of mating cavities spaced from one another in a vertical direction;

plural pairs of contacts retained in the housing, each pair of contacts having a first contact blade and a second contact blade spaced from each other, each of the first contact blade and the second contact blade including a main body, a contacting section forwardly extending from the main body into the corresponding mating cavity; wherein the main body includes a horizontal part from which the contacting section forwardly extends, and a vertical part from which at least one mounting leg extends downwardly into the mounting port;

further including a spacer attached to the mounting port, wherein said spacer including a plurality of positioning holes to retain the corresponding mounting legs, and a plurality of heat dissipation holes which are larger than the positioning holes;

wherein the main portion of the insulative housing includes a top wall with a plurality of heat dissipation holes to cooperate with the heat dissipation holes in the spacer to enhance airflow moving in the vertical direction.

13. The electrical connector as claimed in claim 12, wherein the main portion further includes a pair of side walls each forming a heat dissipation hole extending through a bottom face of the housing.

14. The electrical connector as claimed in claim 12, wherein the mating port forms a plurality of holes extending therethrough in the vertical direction, and the contacting sections are exposed in the corresponding holes for heat dissipation.

* * * * *